United States Patent [19]

Inoue

[11] 4,290,856

[45] Sep. 22, 1981

[54] ELECTROPLATING APPARATUS AND METHOD

[75] Inventor: Kiyoshi Inoue, Tokyo, Japan

[73] Assignee: Inoue-Japax Research Incorporated, Yokohamashi, Japan

[21] Appl. No.: 115,119

[22] Filed: Jan. 24, 1980

[30] Foreign Application Priority Data

Jan. 25, 1979 [JP] Japan ..... 54-7897

[51] Int. Cl.[3] ..... C25D 1/10; C25D 21/12; C25D 21/18

[52] U.S. Cl. ..... 204/4; 204/234; 204/275

[58] Field of Search ..... 204/6, 14 R, 234, 235, 204/236, 275, 4

[56] References Cited

U.S. PATENT DOCUMENTS

| | | | |
|---|---|---|---|
| 2,072,811 | 3/1937 | Ellsworth | 204/236 |
| 3,256,165 | 6/1966 | Williams | 204/14 R |
| 4,045,304 | 8/1977 | Tezuka | 204/234 |

FOREIGN PATENT DOCUMENTS

| | | |
|---|---|---|
| 416527 | 9/1934 | United Kingdom . |
| 970436 | 9/1964 | United Kingdom . |
| 1226658 | 3/1971 | United Kingdom . |
| 1273978 | 5/1972 | United Kingdom . |
| 1293648 | 10/1972 | United Kingdom . |
| 1302926 | 1/1973 | United Kingdom . |
| 1347896 | 2/1974 | United Kingdom . |
| 1360970 | 7/1974 | United Kingdom . |
| 1421818 | 1/1976 | United Kingdom . |
| 1437818 | 6/1976 | United Kingdom . |

OTHER PUBLICATIONS

UK Patent Application GB 2,010,330 A.

*Primary Examiner*—T. M. Tufariello
*Attorney, Agent, or Firm*—Karl F. Ross

[57] ABSTRACT

An electroforming or electrodeposition system in which the depleted metallic component in the electrolyte is replenished by an electrolyzing unit having an anode chamber communicating with the electroforming electrolyte receptacle and separated by an ion-exchange membrance from a cathode chamber. An anode in the anode chamber is dissolved electrolytically to furnish the metallic component. The electroforming current is measured to indicate the rate of depletion of the metallic component from the electroforming electrolyte, the measurement signal being used to control the electrolyzing current to dissolve the metallic component from the anode so that the ionic concentration of the metal in the receptacle is maintained substantially constant.

3 Claims, 1 Drawing Figure

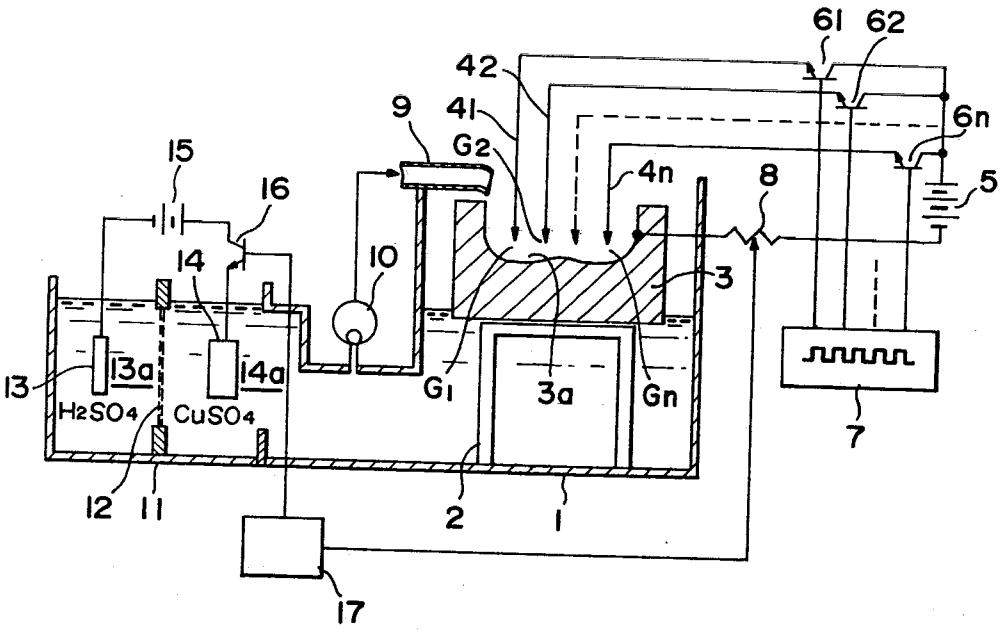
61
62
6n
5
7
8
3
4n
Gn
3a
1
42
41
G2
G1
2
9
10
17
16
14a
14
CuSO4
15
11
13a
H2SO4
12
13

ELECTROPLATING APPARATUS AND METHOD

FIELD OF THE INVENTION

The present invention relates to an electroforming apparatus and, more particularly, to an improved system for electrolytically forming a metallic deposition in a layer on a mold shaped to a predetermined pattern, the deposited layer being subsequently removed to form a desired article.

BACKGROUND OF THE INVENTION

The execution of an electrodeposition process with stability to gain satisfactory results requires a proper monitoring of the composition of an electrolyte furnishing the depositing metal. In an electroforming operation, a large amount of metal is deposited and the electrolyte tends to alter the concentration quickly. It is desired to inspect the composition and to replenish the consumed metal in the electrolyte. The common practice effects replenishment by adding a corresponding metal salt to the solution tending to be depleted of the depositing metal upon inspection from time to time. This procedure has been found to give rise to problems because of possible introduction of impurities which may hinder or even be detrimental to satisfactory metal deposition.

OBJECT OF THE INVENTION

It is accordingly an important object of the present invention to provide an improved electroforming apparatus or system whereby the aforementioned problem is overcome.

SUMMARY OF THE INVENTION

In accordance with the present invention, there is provided an electroforming apparatus comprising: a mold; at least one electrode juxtaposed with the mold to form an electrodeposition gap therebetween; a receptacle for an electroforming electrolyte containing a metal to be electroformed or deposited upon the mold; pumping means for circulating the electrolyte through the electrodeposition gap to supply the latter with the electrolyte; an electroforming power supply connected across the mold and the electrode for passing an electrodeposition current through the gap supplied with the electroforming electrolyte to electrolytically deposit the metal upon the mold from the electrolyte; and electrolyzer means for electrolytically replenishing said metal in the electrolyte in the receptacle, the electrolyzer means including: an anode composed of the metal; an anode chamber defining the region of the anode; an ion-exchange membrance separating the region of a cathode immersed in a cathode bath of the electrolyzer means from the anode chamber; and an electrolyzing power supply connected across the anode and the cathode for electrolytically dissolving the metal from the anode into the anode chamber, the anode chamber and said receptacle being interconnected to allow the electroforming electrolyte to circulate therebetween. The apparatus preferably includes means responsive to the electrodeposition current for acting on the electrolyzing power supply to control the electrolytic dissolution of the metal from the anode in the anode chamber so that the ionic concentration of said metal in said receptacle is maintained substantially constant.

BRIEF DESCRIPTION OF DRAWING

In the drawing, the sole FIGURE is a schematic view partly in section and partly in block form of an apparatus diagrammatically illustrating a certain embodiment of the present invention.

SPECIFIC DESCRIPTION

In an improved system according to the invention, an electroforming unit comprises a receptacle which is generally denoted at 1, a mold 3 fixedly mounted on a table or base 2 and a plurality of electrodes $4_1, 4_2, \ldots, 4_n$ juxtaposed with the mold 3 along a cavity 3*a* thereof. An electroforming power supply comprises a direct-current source 5 having parallel output branches whose common terminal is connected to the mold 3 and other terminals are connected to electrodes $4_1, 4_2, \ldots, 4_n$ via power switches $6_1, 6_2, \ldots, 6_n$ (shown by transistors), respectively. The switches $6_1, 6_2, \ldots, 6_n$ are adapted to be successively turned on and off by a signal pulse generator 7 so that gaps $G_1, G_2, \ldots G_n$ formed between the mold cavity 3*a* and electrodes $4_1, 4_2, \ldots, 4_n$, respectively, are successively energized with a pulsed electrodeposition current. This arrangement allows a uniform deposition over the cavity 3*a*.

The common circuit connection between the DC source 5 and the mold 3 is shown to include a sensing resistor 8 designed to detect the electrodeposition current.

The electroforming (deposition) electrolyte containing a desired deposition metal, e.g. copper or nickel in the receptacle 1 is drawn by a pump 10 and thereby supplied through a nozzle 9 over the mold cavity 3*a* while dynamically traversing the gaps $G_1, G_2, \ldots, G_n$. The electrolyte is then returned by gravity to the receptacle 1 for recycling.

An electrolyzer bath is shown generally at 11, comprising a cathode 13 and an anode 14 separated from each other by an ion-exchange membrane 12 so that two isolated chambers are formed, a cathode chamber 13*a* and an anode chamber 14*a*. The membrane 12 is here of anion type but may be of cation type when a double structure is employed.

The anode chamber 14*a* communicates with the receptacle 1 so that the electrodeposition or electroforming electrolyte such as $CuSO_4$ in the latter should fill the chamber 14*a*. When $CuSO_4$ is used as the deposition electrolyte and hence also as an anode bath in the chamber 14*a*, the cathode chamber 13*a* may then contain $H_2SO_4$ as a cathode bath. The anode 14 should then be composed of copper. The cathode 13 may be copper or another material.

The anode 14 and the cathode 13 are shown energized by an electrolyzing power supply 15 via a switch 16 whose switching operation is controlled by a control circuit 17. The control circuit 17 operates in response to a signal furnished by the sensing resistor 8.

The electrodeposition of a desired metal on the mold cavity 3*a* is effected advantageously in the system shown with a pulsed current which is furnished successively to the electrodes $4_1, 4_2, \ldots, 4_n$ through the divided gaps $G_1, G_2, \ldots, G_n$ when the respective switches $6_1, 6_2, \ldots, 6_n$ are turned on and off in succession. The pulse electrodeposition is especially advantageous in forming a thick deposition layer quickly and efficiently. The quick deposition may result in a quick drop in the ion concentration of the desired metal, e.g. copper, in the electrolyte which is circulated through the receptacle 1. Since the electrolyte is here also free to pass into and away from the anode chamber 14*a* of the electrolyzer unit 11, this drop is effectively replenished by ions of the same metal electrolytically dissolved from the anode 14. The ion-exchange membrance 12 disposed between the anode chamber 14*a* and the cathode chamber 13*a* effectively checks the dissolved metal ions from depositing on the cathode 13 and acts to enhance the concentration of the metal ions in the anode chamber 14*a*. Thus, all the metal ions dissolved from the anode 14 are introduced into the electrodeposition or electroforming electrolyte in the receptacle 1. The rate of introduction of the metal ions of interest is controlled in proportion to the electrolysis in the bath 11 and thus to the electrolyzing current therein.

An important feature of the invention resides in controlling the replenishment of the metal ions by the electrolyzer unit 11 proportionally in accordance with the exhaustion of the metal ions by the electroforming operation in the receptacle 1. Thus, the sensing resistor 8 is provided in the electrodeposition power supply circuit to measure the precise rate of deposition and hence the precise rate of exhaustion of the metal ions. The control circuit 17 is provided to respond to this rate as an electrical signal and the switch 16 provided in the electrolyzing power supply circuit is controlledly operated by the controller 17 to control the electrolyzing current which is supplied by the source 15 on the anode 14 so that the concentration of the metal ions in the receptacle 1 is maintained substantially constant.

There is thus provided an improved electroforming apparatus wherein the replenishment of the depletion (makeup) of the metallic component in the electroforming electrolyte is effected by electrolyzing means which advantageously checks against introduction of impurities into the electroforming electrolyte. This allows the metallic deposition upon the mold to build up uniformly to a desired thickness to yield a satisfactorily homogeneous and densified structural layer. Furthermore, the measurement of the rate of exhaustion is effected automatically or on an in-process basis followed by the automatic replenishment operation so that a separate task of inspection and addition as in the conventional procedure may be advantageously eliminated.

What is claimed is:

1. An electroforming apparatus comprising:

a mold;

at least one electrode juxtaposed with said mold to form an electrodeposition gap therebetween;

a receptacle for an electroforming electrolyte containing a metal to be electrodeposited upon said mold;

pumping means for circulating said electrolyte through said electrodeposition gap to supply the latter with said electrolyte;

an electroforming power supply connected across said mold and said electrode for passing an electrodeposition current through said gap supplied with said electroforming electrolyte to electrolytically deposit said metal from said electrolyte;

electrolyzer means for electrolytically replenishing said metal in the electrolyte in said receptacle, said electrolyzer means including:

an anode composed of said metal;

an anode chamber defining the region of said anode;

an ion-exchange membrane separating the region of a cathode of said electrolyzer means from said anode chamber;

an electrolyzing power supply connected across said anode and said cathode for electrolytically dissolving said metal from said anode into said anode chamber; and said anode chamber and said receptacle being contiguous with each other and interconnected to allow free circulation of said electroforming electrolyte between them and introduction of ions of said metal into said electrolyte in said receptacle at a rate proportional to the rate of electrolysis in said anode chamber.

2. An electroforming apparatus comprising:

a mold;

at least one electrode juxtaposed with said mold to form an electrodeposition gap therebetween;

a receptacle for an electroforming electrolyte containing a metal to be electrodeposited upon said mold;

pumping means for circulating said electrolyte through said electrodeposition gap to supply the latter with said electrolyte;

an electroforming power supply connected across said mold and said electrode for passing an electrodeposition current through said gap supplied with said electroforming electrolyte to electolytically deposit said metal from said electrolyte;

electrolyzer means for electrolytically replenishing said metal in the electrolyte in said receptacle, said electrolyzer means including:

an anode composed of said metal;

an anode chamber defining the region of said anode;

an ion-exchange membrane separating the region of a cathode of said electrolyzer means from said anode chamber;

an electrolyzer power supply connected across said anode and said cathode for electrolytically dissolving said metal from said anode into said anode chamber; and said anode chamber and said receptacle being interconnected to allow said electroforming electrolyte to circulate between them; and means responsive to said electrodeposition current for acting on said electrolyzing power supply to control the electrolytic dissolution of said metal from said anode into said anode chamber so that the ionic concentration of said metal in said receptacle is maintained substantially constant.

3. An electroforming method which comprises the steps of:

(a) juxtaposing a mold having a contoured conductive surface with an electrode in an electrolyte containing a metal to be deposited from said electrolyte upon said surface while being depleted from said electrolyte;

(b) passing an electrode deposition current between said electrode and said mold through said electrolyte to effect electrodeposition from said electrolyte of said metal onto said surface;

(c) circulating said electrolyte between a region spaced from said mold and the region of said mold and said electrode, electrolyzing an anode of said metal into said electrolyte at said region spaced from said mold at a rate determined by an electrolyzing current;

(d) monitoring the electrodeposition current passing between the electrode and the mold to produce a signal in response to the rate of depletion of said metal from said electrolyte; and (e) automatically controlling the electrolyzing current in response to said signal to electrolytically dissolve metal into said electrolyte at said region spaced from said mold to maintain the ionic concentration of the metal in the electrolyt substantially constant.

* * * * *